United States Patent [19]

Paulonis et al.

[11] Patent Number: 4,579,602

[45] Date of Patent: Apr. 1, 1986

[54] FORGING PROCESS FOR SUPERALLOYS

[75] Inventors: Daniel F. Paulonis, Higganum; David R. Malley, Manchester; Edgar E. Brown, South Windsor, all of Conn.

[73] Assignee: United Technologies Corporation, Hartford, Conn.

[21] Appl. No.: 565,487

[22] Filed: Dec. 27, 1983

[51] Int. Cl.[4] ..... C22F 1/10

[52] U.S. Cl. ..... 148/11.5 N; 148/12.7 N

[58] Field of Search ..... 148/11.5 N, 12.7 N

[56] References Cited

U.S. PATENT DOCUMENTS

| | | | |
|---|---|---|---|
| 3,620,855 | 11/1971 | Wagner et al. | 148/12.7 N |
| 3,649,379 | 3/1972 | Kotval | 148/12.7 N |
| 3,676,225 | 7/1972 | Owczarski et al. | 148/12.7 N |
| 3,677,830 | 7/1972 | Cox et al. | 148/12.7 N |
| 4,392,894 | 7/1983 | Pearson et al. | 148/12.7 N |

*Primary Examiner*—W. Stallard

*Attorney, Agent, or Firm*—Charles E. Sohl

[57] ABSTRACT

Forging processes are described for cast superalloys. The forgeability of superalloy materials is improved by the development of overaged microstructure. The total forging process is usually performed in a series of steps with intervening heat treatments to reform the overaged microstructure.

6 Claims, 1 Drawing Figure

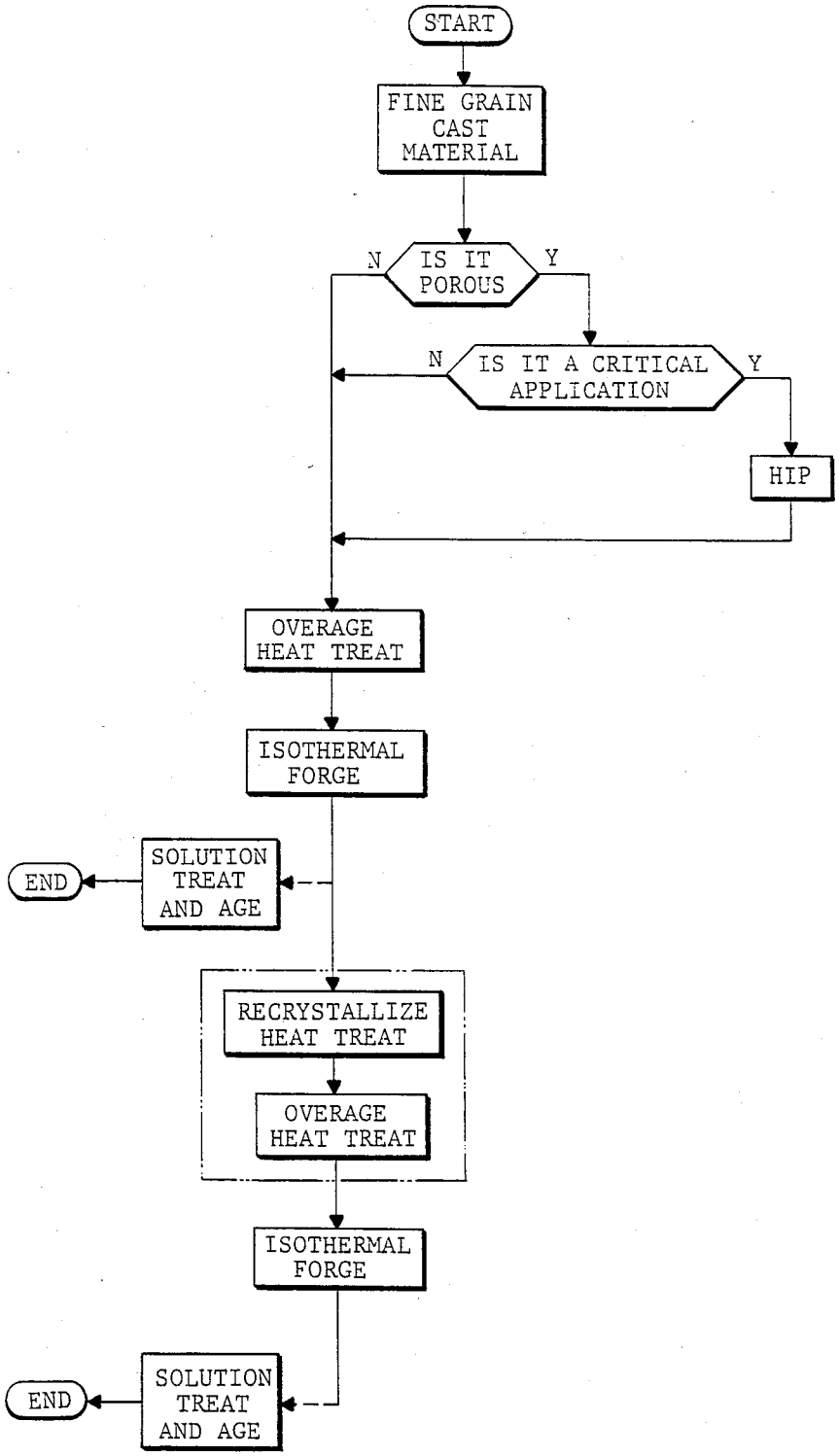
START
FINE GRAIN CAST MATERIAL
IS IT POROUS
N
Y
IS IT A CRITICAL APPLICATION
N
Y
HIP
OVERAGE HEAT TREAT
ISOTHERMAL FORGE
SOLUTION TREAT AND AGE
END
RECRYSTALLIZE HEAT TREAT
OVERAGE HEAT TREAT
ISOTHERMAL FORGE
SOLUTION TREAT AND AGE
END

FORGING PROCESS FOR SUPERALLOYS

DESCRIPTION

1. Technical Field

This invention relates to the forging of high strength nickel base superalloy material, especially in cast form.

2. Background Art

Nickel base superalloys find widespread application in gas turbine engines. One application is in the area of turbine disks. The property requirements for disk materials have increased with the general progression in engine performance. The earliest engines used forged steel and steel derivative alloys for disk materials. These were soon supplanted by the first generation nickel base superalloys such as Waspaloy which were capable of being forged, albeit often with some difficulty.

Nickel base superalloys derive much of their strength from the presence of the gamma prime strengthening phase. In the field of nickel base superalloy development there has been a trend towards increasing the gamma prime volume fraction to increase strength. The Waspaloy alloy used in the early engine disks contained about 25% by volume of the gamma prime phase whereas more recently developed disk alloys contain about 40–70% of this phase. Unfortunately the increase in gamma prime phase which produces a stronger alloy substantially reduces the forgeability of the alloy. Waspaloy material could be forged from cast ingot starting stock but the later developed stronger disk materials could not be reliably forged and required the use of more expensive powder metallurgy techniques in order to produce a shaped disk preform which could be economically machined to the final dimensions. One such powder metallurgy process which has met with substantial success for the production of engine disks is that described in U.S. Pat. Nos. 3,519,503 and 4,081,295. This process has proved highly successful with powder metallurgy starting materials but less successful with cast starting materials.

Other patents relating to the forging of disk material include U.S. Pat. Nos. 3,802,938; 3,975,219 and 4,110,131.

In summary, therefore, the trend towards high strength disk materials has resulted in processing difficulties which have been resolved only through recourse to expensive powder metallurgy techniques.

It is an object of the present invention to describe a method through which high strength materials may be readily forged.

It is another object of the present invention to describe a heat treatment method which substantially increases the forgeability of nickel base superalloy materials.

Yet another object of the present invention is to describe a method for forging cast superalloy materials containing in excess of about 40% by volume of the gamma prime phase and which generally is considered to be unforgeable.

DISCLOSURE OF INVENTION

Nickel base superalloys derive most of their strength from the presence of a distribution of gamma prime particles in the gamma matrix. This phase is based on the compound $Ni_3Al$ where various alloying elements such as Ti and Cb partially substitute for the Al. Refractory elements Mo, W, Ta and Cb also strengthen the gamma matrix phase. Substantial additions of Cr and Co are usually present along with the minor elements such as C, B and Zr.

Table I presents nominal compositions for a variety of superalloys which are used in the hot worked condition. Waspaloy can be conventionally forged from cast stock. The remaining alloys are usually formed from powder, either by direct HIP consolidation or by forging of consolidated powder preforms; forging is usually impractical because of the high gamma prime fraction although Astroloy is sometimes forged without resort to powder techniques.

A composition range which encompasses the alloys of Table I, as well as other alloys which appear to be processable by the present invention, is (in wt. percent) 5–25% Co, 8–20% Cr, 1–6% Al, 1–5% Ti, 0–6% Mo, 0–7% w, 0–5% Ta, 0–5% Cb, 0–5% Re, 0–2% Hf, 0–2% V, balance essentially Ni along with the minor elements C, B and Zr in the usual amounts. The sum of the Al and Ti contents will usually range from 4–10% and the sum of Mo+W+Ta+Cb will usually range from 2.5–12%. The invention is broadly applicable to nickel base superalloys having gamma prime contents ranging up to 75% by volume but is particularly useful in connection with alloys which contain more than 40% and preferably more than 50% by volume of the gamma prime phase and are therefore otherwise unforgeable by conventional (nonpowder metallurgical) techniques.

TABLE I

| | Waspaloy | Astro-loy | RENE 95 | AF 115(2) | RCM 82(3) MERL 76 | IN 100(1) |
|---|---|---|---|---|---|---|
| Co | 13.5 | 17 | 8 | 15 | 18 | 15 |
| Cr | 19.5 | 15 | 13 | 10.7 | 12 | 10 |
| Al | 1.3 | 4 | 3.5 | 3.8 | 5.0 | 4.5 |
| Ti | 3.0 | 3.5 | 2.5 | 3.9 | 4.35 | 4.7 |
| Mo | 4.3 | 5.25 | 3.5 | 3.0 | 3.2 | 3 |
| W | — | — | 3.5 | 6.0 | — | — |
| Cb | — | — | 3.5 | 1.7 | 1.3 | — |
| C | .08 | .06 | .07 | .05 | .025 | .18 |
| B | .006 | .03 | .010 | .02 | .02 | .014 |
| Zr | .06 | — | .05 | .05 | .06 | .06 |
| Ni | Bal | Bal | Bal | Bal | Bal | Bal |
| % $\gamma'$(4) | 25 | 40 | 50 | 55 | 65 | 65 |

(1)Also contains 1.0% V
(2)Also contains .75% Hf
(3)MERL 76 contains .4% Hf
(4)Volume percent A flow chart which outlines various embodiments of the invention is set forth in the FIGURE. Referring to the FIGURE the first requirement for the invention process is that the starting material be a cast material having a fine grain size. In disk forging preforms, cast using conventional techniques, the grain size would be substantially greater than ASTM-3 with typical grain sizes greater than 0.5 in. The present invention requires that the grain size be equal to or finer than ASTM-0 and preferably finer than ASTM-2. Table I presents the relationship between ASTM number and average grain diameter.

TABLE I

| ASTM No. | Average Grain Diameter, MM |
|---|---|
| −1 | 0.50 |
| 0 | 0.35 |
| 1 | 0.25 |
| 2 | 0.18 |
| 3 | 0.125 |

Thus the requirements placed on grain size means that the starting material for use with the present invention will be substantially finer in grain size than typical conventional cast material. One method for producing fine grain starting material is disclosed in U.S. Pat. No. 4,261,412 which is assigned to Special Metals Corporation. Most of the invention development work described herein was performed using starting materials supplied by Special Metals Corporation, which materials are believed to have been produced according to the teachings of this patent.

The fine grain starting material will typically be subjected to a HIP treatment (hot isostatic pressing). This process consists of simultaneously exposing the material to high temperatures (e.g. 2000° F.) and high external fluid pressure (e.g. 15 ksi). Such a HIP process will have the beneficial effect of closing internal microporosity which is commonly found in superalloy castings and may also have a beneficial effect on the overall homogeneity of the material. Such a HIP treatment may not be required if the final application of the superalloy component is a noncritical application where porosity can be tolerated. Likewise, if a casting process were available which could produce a porosity free casting, the HIP cycle would not be required.

The next step in the process is an overage heat treatment. The purpose of this step is to produce a coarse gamma prime distribution. It has been discovered that a coarse gamma prime distribution materially reduces the susceptibility of the material to cracking during forging and also reduces the flow stress of the materials. An overaged structure can be produced by holding the material at a temperature slightly (e.g. 10°–100° F.) below the gamma prime solvus temperature for an extended period of time. Such a treatment will produce a gamma prime particle size on the order of 1 to 2 microns. In the context of the present invention an overaged structure is one in which the average gamma prime particle size at the forging temperature exceeds 0.7 micron and preferably exceeds 1 micron. By way of contrast, when the material is given a conventional heat treatment consisting of a solution heat treatment followed by quenching following by aging (to produce useful mechanical properties), the gamma prime size will be less than about one-half micron.

Following the overage heat treatment step, the material is isothermally forged. The term isothermal forging encompasses processes in which the die temperature is close to the forging preform temperature (i.e. +100° F. −200° F.) and in which the temperature changes during the process are small (i.e. ±100° F.). Such a process is performed using dies which are heated close to the workpiece temperature. The isothermal forging step is performed at a temperature near but below the gamma prime solvus temperature and preferably between about 100° and 200° below the gamma prime solvus temperature. Use of a forging temperature in this range will produce a partially recrystallized microstructure having a relatively fine grain size.

Routine experimentation may be required to determine the maximum reduction which can be performed during this isothermal forging step. It will usually be the case that the reduction required to produce the desired final configuration and desired amount of work in the material will not be attainable in one forging step without cracking. To avoid cracking, multiple forging steps are employed along with the requisite intermediate overage heat treatment steps. When the appropriate amount of work (as determined by experimentation) has been performed, the material is removed from the forging apparatus and given another heat treatment or optionally two heat treatments. As shown in the FIGURE, the first heat treatment is one which will produce a significant amount of recrystallization (i.e. more than about 20% by volume) and the second heat treatment is another overage heat treatment. The recrystallization heat treatment will generally be performed under conditions quite similar to those required for the overage heat treatment so that the two heat treatments will often be combined. The recrystallization heat treatment will preferably be performed above the isothermal forging temperature but still below the gamma prime solvus while the overage heat treatment will be performed under the previously mentioned conditions. It should be observed that the temperature for the second overage heat treatment may not be exactly that temperataure which is optimum for the first overage heat treatment. This is a consequence of the slight change in the gamma prime solvus temperature which may occur during processing as a result of increased homogeneity.

Following the second overage heat treatment step, further isothermal forging is performed. Again it should be noted that the optimum conditions for the second isothermal forging step may differ somewhat from those for the first isothermal forging step and typically a greater amount of deformation can be tolerated in the second forging step without cracking. In the event that the desired final configuration cannot be achieved using two isothermal forging steps additional steps involving the recrystallization/overage heat treatment followed by isothermal forging can be performed until the desired configuration is achieved. Once the desired final configuration is achieved the material will be given a conventional solution heat treatment and aging step with a view toward establishing the optimum final gamma prime morphology for the provision of maximum mechanical properties during use.

Other features and advantages will be apparent from the specification and claims and from the accompanying drawing which illustrates an embodiment of the invention.

BRIEF DESCRIPTION OF DRAWING

The FIGURE is a flow chart showing the possible invention steps.

BEST MODE FOR CARRYING OUT THE INVENTION

A material containing 18.4% Co, 12.4% Cr, 3.2% Mo, 5% Al, 4.4% Ti, 1.4% Nb, 0.04% C, balance essentially nickel was obtained in the form of a 5" diameter by 10" along cylindrical casting. The approximate grain size was about ASTM-0 (0.35 mm average grain diameter). This casting was obtained from the Special Metals Corporation and is believed to have been produced using the teachings of U.S. Pat. No. 4,261,412. This material has a eutectic gamma prime solvus temperature of about 2200° F.

The material was HIPped at 2160° F. at 15 ksi applied pressure for 3 hours. The material was then overaged at 2050° F. for 4 hours and isothermally forged at 2050° F. using dies heated to 2050° F. A 50% reduction was achieved using a 0.1 in/in/min strain rate. The material was then recrystallized at 2100° F. for 1 hour and overaged at 2050° F. for 4 hours. The final step in the process was isothermally forging at 2050° F. at a strain rate of 0.1 in/in/min to achieve a further reduction of 40% for a total reduction of 80%. An attempt was made to forge this material without using the invention sequence and cracking was encountered at 30% reduction.

It should be understood that the invention is not limited to the particular embodiments shown and described herein, but that various changes and modifications may be made without departing from the spirit and scope of this novel concept as defined by the following claims.

We claim:

1. A method of forging fine grained cast superalloy materials including the steps of a. overaging the material to produce a coarse gamma prime distribution;

b. isothermally forging the overaged material.

2. A method of forging fine grained cast superalloy materials including the steps of a. overaging the material to produce a coarse gamma prime distribution;

b. isothermally forging the overaged material without causing significant cracking;

c. recrystallizing the material;

d. overaging the material;

e. isothermally forging the material.

3. A method as in claim 2 in which steps c and d are combined.

4. A method as in claim 1 in which the starting material has a grain size of ASTM-1 or finer.

5. A method as in claim 1 in which the starting material has a grain size of ASTM-2 or finer.

6. A method as in claim 1 in which the starting material has been given a HIP treatment to reduce porosity.

* * * * *